US006668608B1

(12) United States Patent
Derman

(10) Patent No.: US 6,668,608 B1
(45) Date of Patent: Dec. 30, 2003

(54) VALET KEY RING HOLDER

(76) Inventor: Jay S Derman, P.O. Box 3823, Palos Verdes, CA (US) 90274-9533

( * ) Notice: Subject to any disclaimer, the term of this patent is extended or adjusted under 35 U.S.C. 154(b) by 0 days.

(21) Appl. No.: 10/436,474

(22) Filed: May 13, 2003

(51) Int. Cl.[7] ..... A44B 15/00
(52) U.S. Cl. ..... 70/456 R; 70/457; 70/34; 24/3 K
(58) Field of Search ..... 70/456 R, 459, 70/33, 34, 386, 460; 24/3 K

(56) References Cited

U.S. PATENT DOCUMENTS

| | | | | | |
|---|---|---|---|---|---|
| 760,410 | A | * | 5/1904 | Arnold | 70/457 |
| 1,199,690 | A | * | 9/1916 | Gillan | 70/457 |
| 1,315,528 | A | * | 9/1919 | Schuler | 70/457 |
| 1,438,264 | A | * | 12/1922 | Rygh | 70/457 X |
| 1,923,025 | A | * | 8/1933 | Morse et al. | 70/34 |
| 2,465,328 | A | * | 3/1949 | Modrey | 70/457 |
| 2,599,660 | A | * | 6/1952 | Poutinen | 70/457 |
| 2,674,774 | A | * | 4/1954 | Modrey | 70/457 X |
| 2,676,822 | A | * | 4/1954 | Modrey | 70/457 |
| 2,702,928 | A | * | 3/1955 | Nielsen | 70/457 X |
| 3,186,196 | A | * | 6/1965 | Moberg | 70/34 |
| 3,600,917 | A | * | 8/1971 | Krock | 70/457 |
| 3,714,802 | A | * | 2/1973 | Morse et al. | 70/34 |
| 4,349,951 | A | * | 9/1982 | Wefler | 70/457 X |
| 4,637,234 | A | * | 1/1987 | Mielonen | 70/34 |
| 4,713,951 | A | * | 12/1987 | Ros | 70/456 R |
| 4,821,543 | A | * | 4/1989 | Scungio | 70/456 R |
| 5,058,405 | A | * | 10/1991 | Stillwagon | 70/456 |
| 5,209,090 | A | * | 5/1993 | Stillwagon | 70/456 R |
| 5,457,976 | A | * | 10/1995 | Stillwagon | 70/456 R |
| 6,405,572 | B1 | * | 6/2002 | Seamans | 70/456 R |

* cited by examiner

*Primary Examiner*—Suzanne Dino Barrett
(74) *Attorney, Agent, or Firm*—Monty Koslover

(57) ABSTRACT

A dual-sided key ring holder that allows a key ring to be released from one end. The device uses a real or equivalent shell casing, and a real or equivalent shaped bullet member that fits in the mouth of the shell casing. The bullet member includes a hole in the nose for fastening a key ring thereto. A spring-loaded piston which is disposed inside the shell casing, normally acts on the bullet member to retain the bullet member in the casing. The piston includes a rigid tab which projects from the head of the shell casing and may be manually pulled to release the bullet member with a key ring from the casing. Provision is also made for fastening a key ring to the tab.

3 Claims, 2 Drawing Sheets

VALET KEY RING HOLDER

BACKGROUND OF THE INVENTION

1. Field of the Invention

This invention relates to small, easily pocketed devices for holding keys and partidularly to key ring holders that provide for a key to be quickly disengaged from the holder.

2. Background

There exists a number of key ring holder devices which provide for any given attached key to be quickly disengaged or replaced. This action is a necessity when handing over a car to a valet for parking However, a commonly heard complaint is that keys are apt to occasionally fall off presently available key ring holders. If a key happens to fall in a relatively dark environment or it is not noticed to fall, it is likely to become lost to the owner. There is therefore a perceived need for a key ring holder that will securely hold a key ring with its keys, and not permit a key to accidentally fall away.

SUMMARY OF THE INVENTION

The invention is a bullet shell casing or rifle cartridge shaped dual sided key ring holder, allowing a key ring to be released from one end. The device uses a real or equivalent shell casing and a real or equivalent shaped bullet that fits in the mouth of the shell casing. The bullet member includes a hole in its nose for fastening a key ring thereto. A spring-loaded piston is axially disposed inside the shell casing and normally acts on the bullet member to retain it in the casing. The piston includes a rigid tab which projects from the head of the shell casing and may be manually pulled to release the bullet member. Provision is made for fastening a key ring to the tab member.

Accordingly, it is a principal object of the present invention to provide a key ring holder that will provide for quick manual disengagement and replacement of a key ring with attached keys, while securing a key ring from accidental disengagement.

Further objects and advantages of the invention will be apparent from studying the following portion of the specification, the claims and the attached drawings.

BRIEF DESCRIPTION OF THE DRAWINGS

FIG. 5 is an elevation view of the piston, according to the present invention; and.

DESCRIPTION OF THE PREFERRED EMBODIMENT

Figure 1:
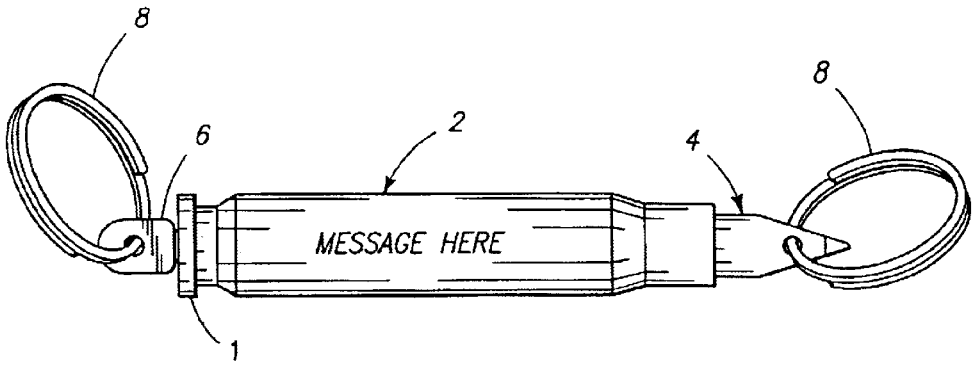
FIG. 1 is a side elevation view of a preferred embodiment of a key ring holder device according to the present invention, shown with attached key rings.

Referring particularly to the drawings, there is shown in FIG. 1, a side elevation vie w of a preferred embodiment of the present invention key ring holder device, with a key ring 8 attached to each end. The device comprises a modified bullet shell casing or rifle cartridge shell casing 2, a modified bullet member 4 which is normally retained in the shell casing 2, and means for locking or releasing the bullet member 4 from the shell casing 2. Pulling axially on a tab 6 that protrudes from the head 1 end of the shell casing 2, releases the bullet member 4, allowing it to be withdrawn with its key ring 8 and attached keys. The bullet member 4 is returned to the shell casing 2 by simply inserting the flat end of the bullet member 4 in the mouth of the shell casing and pushing the bullet member in until it snaps in place. The bullet member 4;will then be secured and can not be shook free. Thus, car keys or other keys that are attached to the invention device, can not accidentally fall off the key ring holder and be lost.

As shown in FIG. 1, there is room for a message or business logo to be imprinted on the body 15 of the shell casing 2 as an identifier,if so desired.

Figure 2:
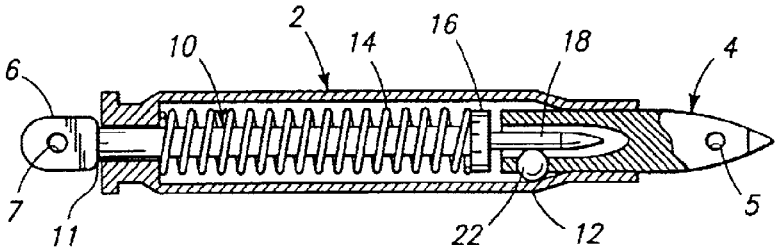
FIG. 2 is a cross-section side elevation view of the key ring holder device according to the present invention, particularly showing a bullet member held locked in a cartridge case by a spring-loaded piston.
Figure 3:
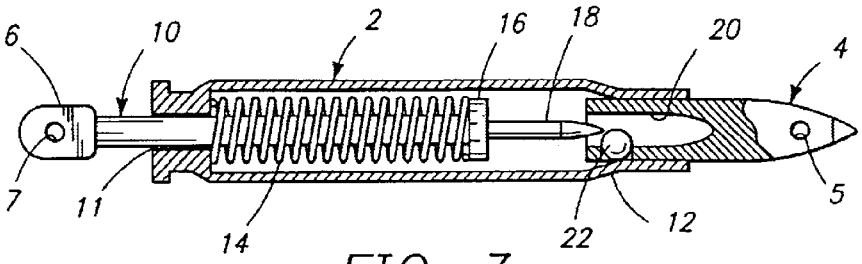
FIG. 3 is a cross-section side elevation view of the key ring holder device, particularly showing the spring-loaded piston sufficiently withdrawn from the bullet member to let the bullet member be pulled out of the cartridge case.

Referring now to FIGS. 2 and 3, there is shown in cross-section view, the two states of locking and releasing the bullet member 4, as well as detail of the means for locking and releasing the bullet member. In FIG. 2 the key ring holder device is depicted in a normally locked state, with the bullet member 4 prevented from being withdrawn from the shell casing 2.

The preferred means for locking and releasing the bullet member from the shell casing, is a spring-loaded piston 10 which acts on a ball bearing 22 that is embedded in the wall of an axial cavity 20 in the bullet member. A piston 10, with a helical compression, spring 14 around the piston body and against a piston flange 16, is disposed axially inside the shell casing 2. One end of the piston 10 passes. slidingly through an end opening 11 in the head 1 of the shell casing 2 for support, leaving the spring 14 somewhat compressed. At the opposite end of the piston, an attached pin member 18 with a tapered end floats. A rigid, flat tab 6, that is connected to the supported external end of the piston, acts as a stop to the piston being pulled by the spring 14 completely into the shell casing 2. The tab 6 also provides a convenient projection with which to manually pull out the piston as required for releasing the bullet member 4.

As shown in FIG. 2, with the pull tab 6 held against the shell casing head 1, the piston pin member 18 occupies an axial bore 20 in the bullet member 4. In so doing, the pin member presses against a ball bearing 22 embedded in the side wall of the bore 20. This action causes the ball bearing 22 in turn to press fixedly against the surface of the shell casing 2 inside the casing shoulder 12. The fixed ball bearing position then restrains the bullet member 4 from being withdrawn out through the casing neck 13, which is narrower than the shoulder portion 12, and out of the shell casing mouth 3.

FIG. 3 shows the key ring holder device in a bullet release state, where the bullet member 4 is no longer restrained from being extracted from the shell casing 2.

To achieve a release state, using the tab 6, the piston 10 is manually pulled axially, a distance out of the shell casing 2 so that the piston pin member 18 is sufficiently withdrawn from the bullet member cavity 20. The pin member 18 then ceases to impinge on the ball bearing 22 and releases the bullet member 4 which can,then be manually withdrawn from the shell casing 2.

A first hole 5 is cut in the nose of the bullet member 5 for fastening a key-ring thereto. A second hole 7 is cut in the pull tab 6 to provide for fastening a key ring or other device thereto as desired by the user.

Figure 4B:
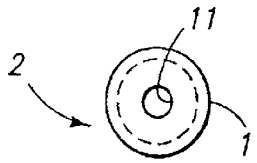
FIGS. 4A and 4B are respectively, a side elevation view of a cartridge case that is adapted for the device, and a cartridge head end view, particularly showing a widened vent hole for holding the piston.
Figure 4A:
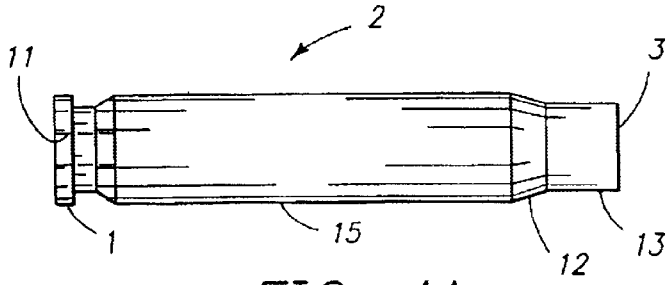

Refer now to FIGS. 4A and 4B, which are respectively, a side elevation view and an end view of the shell casing 2.

The shell casing 2 is a hollow metal cylinder, having a mouth 3 opening at one end and closed portion called a "head" 1 at its distal end. A narrow neck portion 13 and shoulder portion 12 connects the mouth 3 opening to the body 15 of the shell casing. An lend opening 11 is cut axially in the head 1 that communicates with the hollow interior of the body 15. The end opening 11 is sized to enclose and slidingly support an inserted end of the piston 10.

The shell casing 2 may be a real empty bullet shell casing or rifle cartridge shell casing such as used for a .308 Winchester rifle cartridge. Or it may be a manufactured metal hollow casing having the equivalent shape of a standard shell casing as described above. If a real empty shell casing is used, the vent hole in the head 1 will have been bored out to the required axial end opening 11 diameter.

Figure 5:
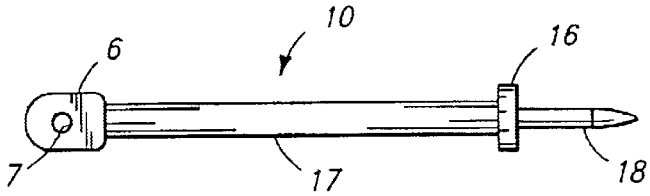

FIG. 5 is a side elevation view of a piston 10 according to the present invention. The piston 10 comprises four portions that are joined axially together to form a single rigid member. An elongate cylindrical rod 17 portion is attached at one end to a flat tab 6 portion, and at its distal end to a circular disc shaped flange 16. A pin member 18 is attached at one end to the center of the flange 16, and aligned with the rod portion. The free end of the pin member 18 is tapered.

The piston 10 may be assembled using separate rod, tab, flange, and pin members that are then fastened together as required. Or the piston may be formed from a single metal cylindrical rod, or a rigid plastic material. The method selected will depend primarily on manufacturing costs.

Figure 6B:
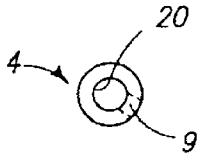
FIGS. 6A and 6B are respectively, an elevation view and an end view of the bullet member, particularly showing an axial bore, a key ring hole in the bullet nose portion and an opening in a bullet member side for holding a ball bearing.
Figure 6A:
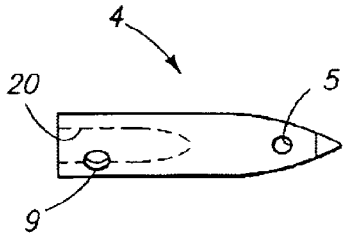

Refer now to FIGS. 6A and 6B which are respectively, a side elevation view and an end view of the bullet member 4. The bullet member 4 may be a real bullet or a substitute metal member having a similar shape and sized to fit in the shell casing 3. As illustrated, an axial bore 20 is made in one end of the bullet member 4. The bore 20 is sized to permit full entry with clearance by the pin member 18 at the free end of the piston 10, as shown in FIG. 2.

A first hole 5 is cut through the nose portion of the. bullet member 4 for fastening a key-ring thereto, and an opening 9 is made in the side of the bullet member, into the bore 20 to hold a ball bearing 22.

The key ring holder device may be used with a single key ring attached to the bullet member 4, with the tab portion 6 used only for releasing the bullet member 4. In that case, the second hole 7 in the tab 6 portion may be omitted. Further, the tab portion 6 may be modified to include a fastening for an item such as a miniature LED light which is helpful for unlocking a car door in an unlit area.

The invention device is rugged in construction, is inexpensive to produce and should have a long, useful life. It is believed that the device shape and characteristics will appeal to gun owners and enthusiasts, as well as to the many persons who have had the misfortune to lose car keys that accidentally came loose from their key holder.

From the foregoing description, it is believed that the preferred embodiment achieves the objects of the present invention. Various modifications and changes may be made to the invention device described above which are apparent to those skilled in the art. These alternatives and modifications are considered to be within the scope of the appended claims and are embraced thereby.

What is claimed is:

1. A key ring holder device, which comprises:

(a) a metal bullet member; said bullet member including an axially extending bore with an opening at one end, a first hole cut transversely in a distal end of said bullet member, and a second opening cut in a side of said bullet member, through to said bore;

(b) a ball bearing that fits and is held in said second opening in said bullet member;

(c) a metal shell casing having the equivalent shape of a rifle cartridge casing or bullet shell casing; said shell casing comprising:

a hollow cylindrical body portion;

a disc shaped head member that is attached to one end of said body, closing off said body, said head member including an axially bored third opening;

a narrow, cylindrical neck portion having a mouth opening which is sized to slidingly accept said bullet member; and, a transition shoulder portion which is attached axially to a distal end of said body portion and to said neck portion; and (d) a spring-loaded longitudinally driven piston, comprising:

a rigid metal, circular rod piston member; and a helical compression spring which is fitted surrounding said piston member; said piston member including a circular flange that is mounted concentrically near one end, a wide, rigid tab member that is fastened to a distal end of said piston member, and a pin member which is attached coaxially to said flange, said pin member having a tapered free end;

said piston being disposed axially inside said body portion of said shell casing and having an end including said tab member, projecting axially through said third opening in said shell casing; said spring normally exerting pressure on said flange, causing said pin member to enter said bore in said bullet member and impinge on said ball bearing which is mounted in a wall of said bore; said ball bearing in response, being moved to impinge on an inner surface of said shoulder portion of said shell casing, preventing said bullet member from being withdrawn from said shell casing.

2. The device according to claim 1, wherein said tab member includes a second hole that is sized for fastening a key-ring thereto.

3. The device according to claim 1, wherein said piston member is fabricated from a rigid, plastic material.

* * * * *